United States Patent [19]

Hoetzl et al.

[11] Patent Number: 5,035,610

[45] Date of Patent: Jul. 30, 1991

[54] INTERNAL HEAT EXCHANGE TUBES FOR INDUCTRIAL FURNACES

[75] Inventors: Max Hoetzl, Toledo, Ohio; Thomas M. Lingle, Temperance, Mich.

[73] Assignee: Surface Combustion, Inc., Maumee, Ohio

[21] Appl. No.: 557,324

[22] Filed: Jul. 23, 1990

[51] Int. Cl.[5] ..... F27D 15/02

[52] U.S. Cl. ..... 432/77; 432/176; 432/199; 432/250

[58] Field of Search ..... 432/77, 176, 205, 206, 432/199, 250

[56] References Cited

U.S. PATENT DOCUMENTS

| | | | |
|---|---|---|---|
| 3,140,743 | 7/1964 | Cone | 165/61 |
| 4,275,569 | 6/1981 | Mayers et al. | 62/373 |
| 4,395,233 | 7/1983 | Smith et al. | 432/176 |
| 4,789,333 | 12/1988 | Hemsath | 432/250 |
| 4,906,182 | 3/1990 | Moller | 432/77 |
| 4,963,091 | 10/1990 | Hoetzl et al. | 432/199 |

*Primary Examiner*—Henry C. Yuen

*Attorney, Agent, or Firm*—Body, Vickers & Daniels

[57] ABSTRACT

An internal heat exchange tube for cooling work within an industrial furnace is positioned to extend within the furnace and is closed at its axial end which is inside the furnace. Within the tube is an open ended, thin wall inner tube formed in the shape of a helical coil. Water introduced into the inner tube distributes thermally induced, circumferential stress gradients about both tubes to prevent tube bending while achieving fast cooling of the outer tube.

12 Claims, 4 Drawing Sheets

FIG. 4
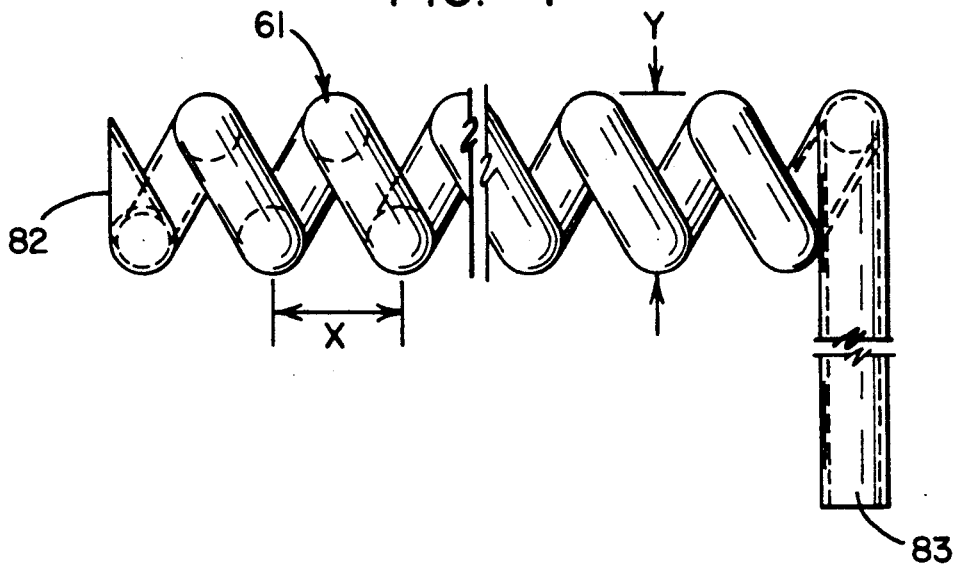
FIG. 5
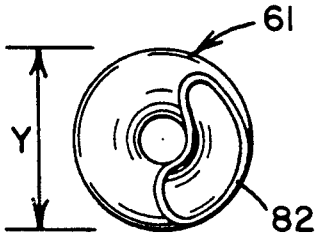
FIG. 6
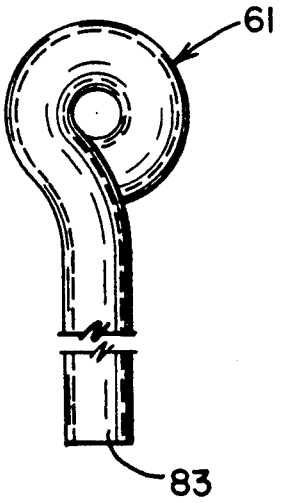
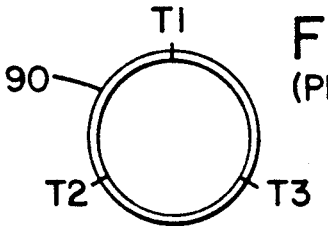
FIG. 8
(PRIOR ART)
FIG. 7
(PRIOR ART)
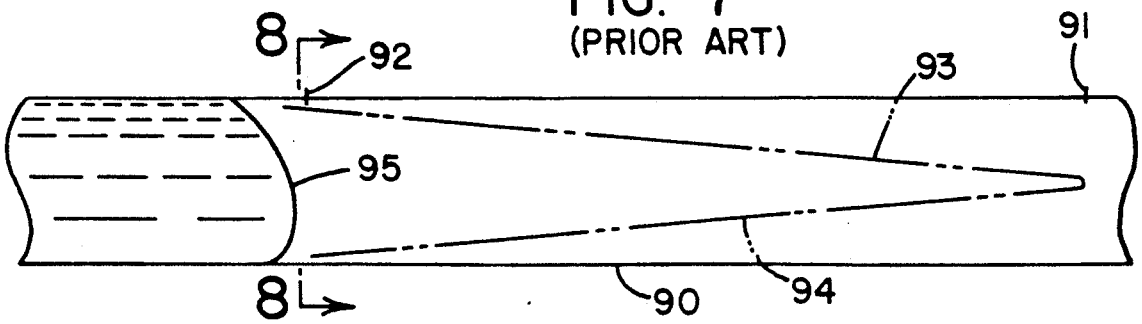

INTERNAL HEAT EXCHANGE TUBES FOR INDUCTRIAL FURNACES

This invention relates generally to the industrial furnace field and more particularly to a convective heat transfer device used for cooling work in the furnace.

The invention is particularly applicable to and will be described with specific reference to an improved, internally positioned heat exchange tube used in a heat treat furnace. However, the invention has broader application and can be employed in applications outside the commercial heat treat field such as in steel mill applications involving batch coil annealers.

INCORPORATION BY REFERENCE

Incorporated by reference and made of part hereof is Cone U.S. Pat. No. 3,140,743 dated July 14, 1964 and Mayers et al U.S. Pat. No. 4,275,569 dated June 30, 1981. These two patents relate to prior art internal heat exchange tubes and are incorporated by reference so that concepts and structure known in the art need not be explained in detail herein while the inventive aspects of this invention can be more readily appreciated.

BACKGROUND OF THE INVENTION

In the heat treat field, metal work is to be heated and cooled in accordance with known, time-temperature-atmosphere composition heat treat processes. Simplistically, the work is heated, held and cooled at specific rates and times while the gaseous or furnace atmosphere surrounding the work is controlled to impart desired metallurgical and mechanical properties to the work. Cooling of the work is physically accomplished in one of two ways.

Typically, a heat exchanger is physically located outside the furnace and air or furnace atmosphere (depending on the heat treat process) which is heated from coming into contact with the hot work is pumped from the furnace through the heat exchanger where it is cooled and then pumped back to the furnace. External heat exchange systems are fundamentally sound. Air infiltration is the major hazard to product quality. All ducts and components must have gas-tight welds and welds which are subjected to severe heating and cooling and must be water cooled, for example by water jackets, to prevent cracking. Thus, the major disadvantages to the external heat exchange systems are higher installation costs, expensive operation and air infiltration. Higher operating costs are due to the need for much larger fans.

To overcome the disadvantages of the external heat exchange systems, Surface Combustion, Inc., the assignee of this invention, developed internal heat exchange tubes initially for application to bell-type coil annealing furnaces. The basic device is disclosed in Cone U.S. Pat. No. 3,140,743 and improved upon in Mayers et al U.S. Pat. No. 4,247,284, both of which are incorporated herein by reference. The internal heat exchange tube marketed by Surface Combustion under the brand name "INTRA-KOOL" has been used in batch-type, industrial heat treat furnaces other than batch coil annealers.

In the internal heat exchange application, a finned tube or pipe is positioned within the furnace with an inlet end outside the furnace and an outlet end also outside the furnace. When the work is to be cooled, a coolant is injected at one end of the tube and the "spent" coolant is recovered at the opposite end. The furnace fan directs the furnace atmosphere over the tubes to establish heat transfer therewith. This cooled atmosphere is then directed by the fan over the work where it is heated from contact therewith and recirculated against the cool tubes, etc.

As discussed in Mayers and in some detail in the Detailed Description of the Invention which follows, if water is the coolant and if water is immediately injected into the tube, high thermal gradients will result in some bending or deformation of the tube and stressing the tube to failure. The problem occurs, as will be explained later, during the initial application of the coolant, i.e. water, in a time frame which can be as short as one-half second and extend to as long as about six seconds. The hot tube vaporizes the water to steam and when the steam barrier is broken by the water plug, circumferential thermal stress gradients occur and bend the tube. Once steady state water flow occurs, the gradients are reduced or eliminated and the tube returns to its original shape. However, the tube is bent. To minimize the problem, the tubes are installed as straight tubes into the furnace with inlet at one end and outlet at the other end. This requires two separate manifolding arrangements for supply and collection of water. Bending the tubes in a circular fashion as shown in the coil annealer prior art patents aggravates the pipe distortion problem.

The short tube life resulting from thermal gradients was addressed in Mayers by injecting initially cool air into the tube followed by increasing amounts of water mist spray prior to injecting the water. Alternatively, water mist spray could be initially injected. The mist spray basically provided for controlled cooling of the tube to a temperature whereat water could be injected without forming the steam barrier. While Mayers addressed and resolved a problem, the cooling rate is necessarily slowed and the temperature gradient, is difficult to control because, in part, steam pockets tend to randomly occur and pipe bending still occurs.

SUMMARY OF THE INVENTION

Accordingly, it is a principal object of the invention to overcome the difficulties of the prior art noted above by providing an improved, internally situated heat exchange device.

This object along with other features of the invention is achieved in an industrial furnace which includes apparatus for cooling the work. The cooling apparatus includes at least one longitudinally-extending outer tube of a predetermined diameter. The outer tube is closed at one axial end while open at its opposite axial end positioned within the furnance so that its open end is outside the furnance. A second open ended, longitudinally-extending inner tube having an outside diameter smaller than the inside diameter of the outer tube is positioned to longitudinally extend within the outer tube. Importantly, the inner tube is bent over a longitudinally-extending portion thereof in the form of a helical coil which snugly fits within the outer tube. A modified arrangement is provided for injecting a coolant into the inner tube at the inner tube's open end which is closest to the outer tube's open end. The coolant initially cools the outer tube by the inner tube and finally cools the outer tube when the coolant exits the inner tube's open end closest the closed end of the outer tube and returns to the open end of the outer tube whereby thermal distortion of the outer tube is minimized.

In accordance with specific features of the inner-outer cooling tube arrangement of the invention, the inner tube coil has a pitch which can be as tight as twice the diameter of the inner tube and the inner tube coil has an outside diameter which is approximately equal to the inside diameter of the outer tube to establish heat transfer partially by conduction between the inner tube and the outer tube. Additionally, the outside diameter of the inner tube is not greater than about ½ the inside diameter of the outer tube. The geometrical relationships assure the non-distortion of the tube which would otherwise occur during initial application of water to the inner tube.

In accordance with still another aspect of the invention, the wall thickness of the inner tube is substantially thinner than the wall thickness of the outer tube which is specified as a pipe thickness to minimize radial temperature gradients within the inner tube while the helical coil shape of the inner tube coil distributes circumferential stress gradients about the inner tube and also about the outer tube in a manner which compensates and prevents bending of either tube. In addition, the outer tube is journaled at both ends in a sliding-sealing arrangement to permit application of a coolant manifold for piping and collecting the water on only one side of the furnace with a minimal amount of openings in the furnace.

In accordance with another aspect of the invention, the invention may be viewed as an improvement to the current Intra-Kool tube which includes closing one end of the outer tube and providing the inner tube arrangement discussed above. Significantly and critical to the invention, the internal cooling tube provides pre-cooling of the outer tube in a slow and uniform manner while also providing a channel for direct contact coolant to back flow in a spiral pattern out of the outer tube.

In accordance with a method feature of the invention, the inner-outer tube, internal heat exchange arrangement described above is filled and heated to an elevated temperature in the heating portion of the heat process cycle. When water under pressure is injected into the open end of the inner tube adjacent the open end of the outer tube, circumferential stress gradients about the inner tube will result as the water flashes to steam while it travels the longitudinal length of the inner tube. Because of the coiled shape of the inner tube, the circumferential stress gradients will rotate to balance out inner tube bending or distortion while at the same time and importantly, the inner tube will effect gradual heat transfer with the outer tube to pre-cool the outer tube. When the steam-water exits the opposite axial end of the inner tube and reverses it direction towards the open end of the outer tube, the coolant will flow in the helical path formed by the inner tube coil to establish circumferential stress gradients which will rotate about the outer tube's wall at the pitch established by the inner tube coil to balance out distortion producing stresses in the outer tube wall and prevent tube failures resulting therefrom.

It is thus a main object of the invention to provide an internal heat exchange apparatus, system and/or method which accomplishes any one or any combination of or all of the following:

a) minimize non-distortion or bending of the internal heat exchange tube;
b) minimize thermal failure or rupture of the internal heat exchange tube;
c) produce faster cooling than heretofore possible; and/or
d) provide easier installation to the furnace.

Still another object of the invention is to provide an internal heat exchange arrangement which permits a straight-line application of the heat exchange which inherently minimizes bending problems in an installation where only one end or side of the furnace needs to be minimally altered to provide for ingress and egress of the heat exchange.

These and other objects and advantages of the invention will become apparent from a reading and understanding of the Detailed Description of the Invention set forth below taken together with the drawings which will be described in the next section.

BRIEF DESCRIPTION OF THE DRAWINGS

The invention may take physical form in certain parts and arrangement of parts, a preferred embodiment of which will be described in detail herein and illustrated in the accompanying drawings which form a part hereof and wherein:

FIG. 4 is a longitudinal view of the inner tube of the heat exchange device of the present invention;

FIGS. 5 and 6 are end views of the inner tube shown in FIG. 4;

FIG. 7 is a schematic illustration of coolant flow in the prior art internal heat exchange device; and FIG. 8 is a sectioned view taken along line 8—8 of FIG. 7 showing a circumferential temperature gradient through the wall thickness of the prior art heat exchange tube.

DETAILED DESCRIPTION OF THE INVENTION

Figure 1:
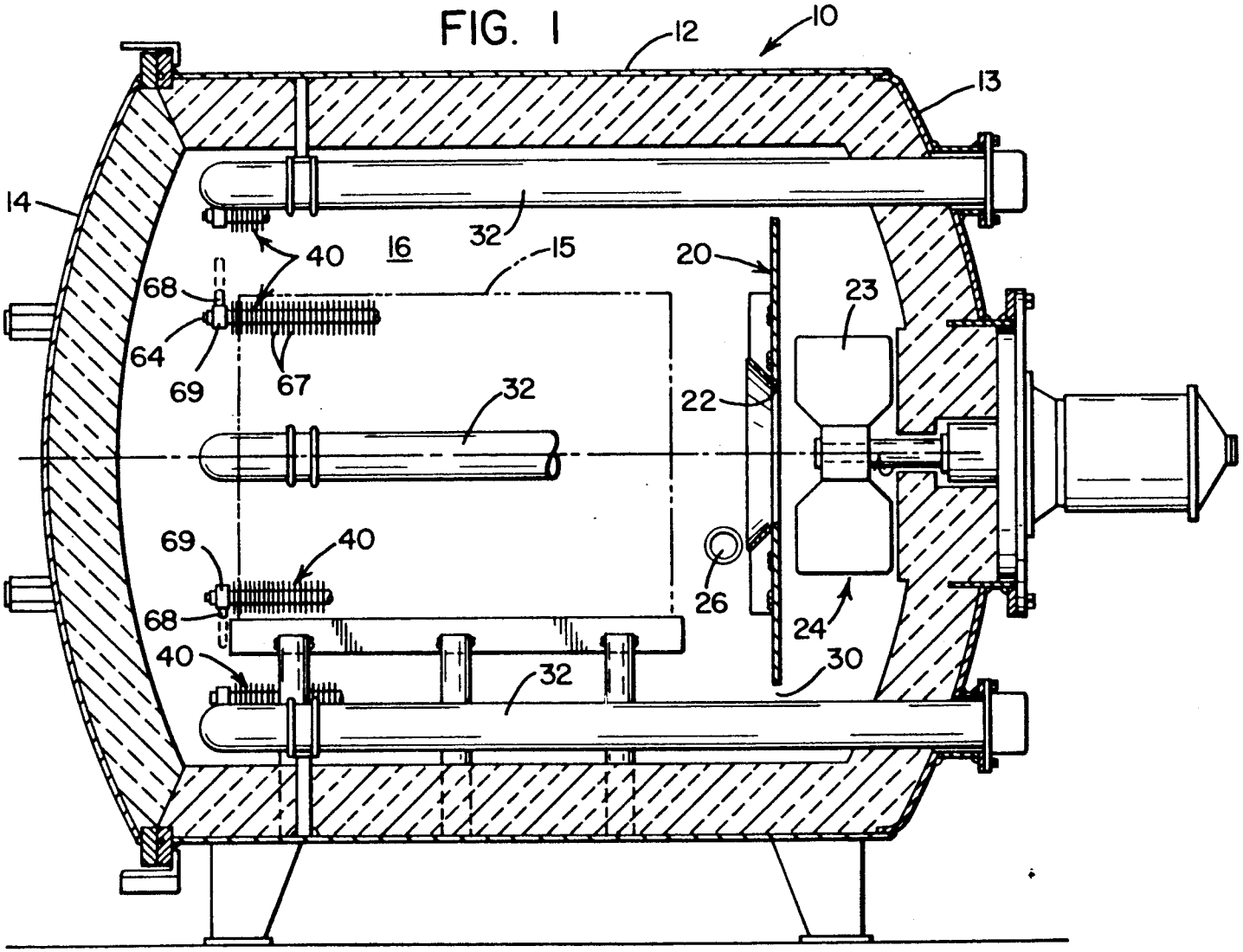
FIG. 1 is a sectioned, side elevation view of an industrial furnace showing portions of the internal heat exchange device of the present invention positioned therein.

Referring now to the drawings wherein the showings are for the purpose of illustrating a preferred embodiment of the invention only and not for the purpose of limiting the same, there is shown in FIG. 1 a heat treat furnace 10. Furnace 10 can be of any type of construction known to those skilled in the art and does not, per se, form a part of this invention. Furnace 10 which is illustrated in the drawings is particularly suited for the present invention and reference may be had to our prior patent Ser. No. 425,686 filed Oct. 23, 1989 now U.S. Pat. No. 4,963,091 issued Oct. 16, 1990, for a more detailed discussion than that presented herein.

Insofar as understanding the present invention is concerned, furnace 10 has a cylindrical section 12 closed at one end by a spherically shaped end wall 13 and openable at its opposite end by a door 14 for receiving work or metal parts loaded in a tray indicated by a phantom line 15 for heat treatment in furnace chamber 16.

An annular fan plate 20 is positioned adjacent end wall 13 and has a central under pressure opening 22 formed therein. Between plate 20 and end wall 13 are blades or impellers 23 of a fan 24. Within furnace 10 is an opening 26 for receiving special gases used to effect various heat treat processes within furnace 10. As thus far described, rotation of impeller 23 causes furnace atmosphere or wind to pass in the space 30 between the outer edge of fan plate 20 and cylindrical furnace section 12 and be drawn back into blades 23 through under pressure opening 26 after passing against or contacting work 15 in heat transfer relationship therewith.

Figure 2:
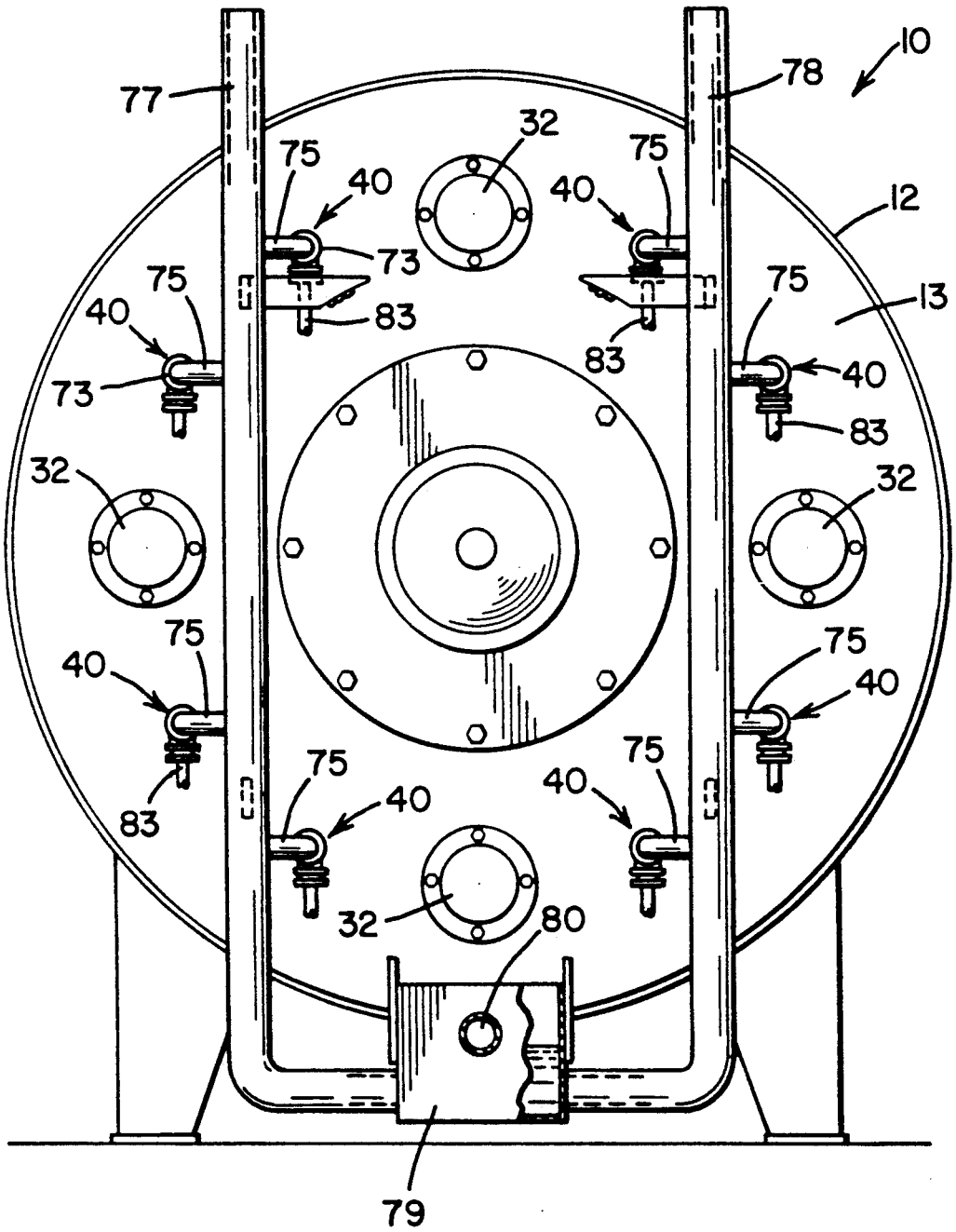
FIG. 2 is a rear end elevation view of the furnace shown in FIG. 1 illustrating the water manifold arrangement of the invention.

In order to provide heat to the work, furnace 10 uses conventional radiant tubes 32 or alternatively electric rod bundle elements. In the furnace 10 illustrated and as best shown in FIGS. 1 and 2, four radiant tubes 32 are circumferentially spaced about cylindrical furnace section 12 and radially located to longitudinally extend in space 30 between the outer edge of annular fan plate 20 and cylindrical furnace section 12. Similarly, a plurality (shown in FIG. 2 as eight in number) of heat exchange tubes 40 longitudinally extend into furnace 10 through end wall section 13 passing through space 30 and are circumferentially spaced about cylindrical furnace section 12. Heat exchange tubes 40 are also radially spaced to extend between the outer edge of fan plate 20 and cylindrical furnace section 12 and radiant tubes 32 and heat exchange tubes 40 are spaced, together, in equal circumferential increments as best shown in FIG. 2.

Furnace 10 operates in a typical fashion. Radiant tubes 32 are heated in a known manner and fan 24 causes the wind, which may comprise a heat treating gas composition admitted through opening 26, to be heated by contact with hot radiant tubes 32 and the heated wind or furnace atmosphere to then heat work 15. Similarly, when work 15 is to be cooled, heat to radiant tubes 32 is shut off and coolant is injected to heat exchange tubes 40 which makes them cool relative to work 15. Fan 24 causes the wind to contact or pass over heat exchange tubes 40 where it is cooled and the cooled wind then contacts work 15 to cool same and in the process thereof be heated by work 15. The heated wind is then drawn through under pressure opening 26 where it is again cooled by contact with heat exchange tubes 40, etc.

Other furnace arrangements will suggest themselves to those skilled in the art. Insofar as the present invention is concerned, it is to be appreciated that internal heat exchange tubes 40 are initially in a hot state because they have been exposed to the furnace heat cycle. Further, heat exchange tubes 40 are initially dry. No coolant or water drip is injected into the tubes before they are actuated with a coolant flow. Finally, some fan arrangement is used to direct hot furnace atmosphere against heat exchange tubes 40 to establish heat transfer therebetween and the "cooled" atmosphere is then directed against work 15 to lower the work temperature.

THE INTERNAL HEAT EXCHANGE TUBE

Figure 3:
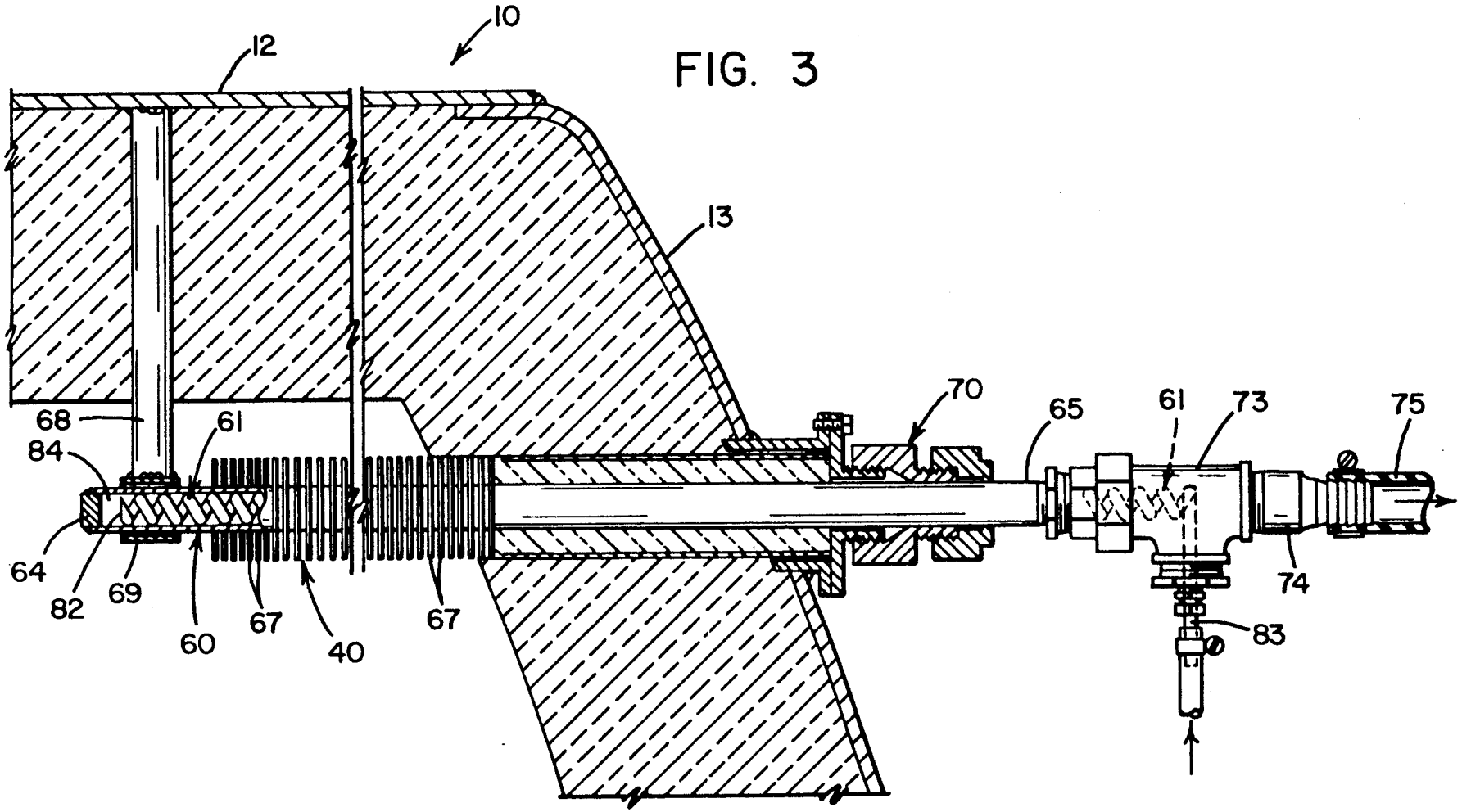
FIG. 3 is a longitudinally sectioned view of the internal heat exchange device of the present invention.

Referring now to FIG. 3, each internal heat exchange tube 40 comprises a longitudinally-extending outer tube 60 and an inner tube 61 which extends longitudinally within outer tube 60. Outer tube 60 is plugged to define a closed axial end 64 which is positioned within heat treat chamber 16. The opposite axial end 65 of outer tube 60 is open and positioned outside furnace 10 adjacent end furnace section 13. The use of the word "tube" to describe outer tube 60 may be a misnomer and outer tube 60 could be viewed as a pipe. In the preferred embodiment, outer tube 60 has a 1" inside diameter and is SCH. 40 pipe (stainless steel) with a wall thickness of 0.133". Attached to the outside surface of outer tube 60 are a plurality of conventional radially extending fins 67 of sheet metal gauge thickness typically made of stainless steel for improving heat exchange with outer tube 60. Fins 67 are conventional and can assume any one of several different shapes. Closed end 69 of outer tube 60 is supported within heat treat chamber 27 by a hanger 68 secured to the casing in cylindrical furnace section 12 and having a sleeve 69 sliding receiving outer tube 60 to permit both longitudinal and radial movement of outer tube 60. Open end 65 of outer tube 60 extends through end wall 13 and can be sealed thereto by a conventional compression type, seal fitting 70 heretofore used in Intra-Kool applications which permits axial expansion of outer tube 61 without breaking a vacuum drawn in furnace 10 if furnace 10 is operated as a vacuum furnace. Alternatively, metal packing such as diagrammatically illustrated in Cone or Mayers et al can be used. Open end 65 of outer tube 60 which is threaded is in turn connected to a tee 73. One outlet of tee 73 is connected by a nipple 74 to a hose 75. As best shown in FIG. 2, hoses 75 from heat exchange tubes 40 on the left hand side of furnace 10 connect to a vertically upright left hand stand pipe 77 or vent while heat exchange tubes 40 which are on the right hand side of furnace 10 are connected to a vertically upright, right hand stand pipe 78 or vent. Stand pipes 77, 78 in turn connect at their base to a drain box 79 which in turn has a drain outlet 80 therefrom. When water is applied to internal heat exchange tubes 40 and steam is produced, the steam exits from the top of stand pipes 77, 78 and also condenses and collects in drain box 79. When water exits heat exchange tubes 40, the water is collected in drain box 79 and exits continuously therefrom through drain outlet 80.

Referring now to FIGS. 3 through 6, inner tube 61 extends substantially the length of outer tube 60 and is open at its inner axial end 82 and outer axial end 83. Inner tube 61 is a thin-walled, stainless steel tubing which has an outside dimension no greater than about one-half that of the inside diameter of outer tube 60. In the preferred embodiment, inner tube 61 has a $\frac{3}{8}$" outside diameter, a wall thickness of 0.020" and is formed of 304 stainless steel annealed tubing. As best shown in FIG. 5, inner tube 61 is formed into the shape of a helical coil which coil spirals the length of outer tube 60. In the preferred embodiment, the coil configuration is formed by filling inner tube 61 with "Norton" 46 grit 3B alumdum sand and the tube is rolled around a $\frac{1}{2}$" diameter bar to form the helical coil. More specifically, the coil is formed by bending around a $\frac{1}{2}$" diameter bar at a turn angle which results in an outside dimension of the coil of about 1" and an inside diameter of the coil of about $\frac{1}{4}$". The coil has a pitch shown as distance "X" in FIG. 5 which can be as tight as twice the diameter of inner tube 61, i.e. $\frac{3}{4}$" in the preferred embodiment. "Pitch" is used herein in the same sense that it is used in the compression spring and screw thread art and means the distance from any point on a coil or coil turn to the corresponding point on the next coil or coil turn measured parallel to the longitudinal axis of the coil. When the pitch is established at twice the distance of the diameter of inner tube 61, the angle of the coil or the included angle formed between the turns of the coil is about 60°. Because of deviations which may occur in forming inner tube 61 as a coil, a true helix may not in fact be formed and it is to be understood that the use of the term "helix" herein is intended to cover any and all variations from a true helix which may occur when inner tube 61 is rolled about a rod.

Finally, the outside diameter of the coil is shown as dimension Y and is slightly less than the inside diameter of outer tube 60 so that inner tube 61 can slip inside outer tube 60. When slipped inside outer tube 60, various portions of the helical coil will contact the inside surface of outer tube 60. Internal end 82 of inner tube 61 which, as shown in FIGS. 4 and 5, is a saw cut end and is adjacent closed end 64 of outer tube 60 with a nominal space 84 provided therein for axial expansion of inner tube 61 relative outer tube 60 although significant uncoiling does not occur. As best shown in FIGS. 4 and 6, outer open end 83 of inner tube 61 is formed as a vertically extending stem to fit within the center leg of tee 73 which can be fitted to a common water line (not shown) for the entire furnace 10. It is possible to vary the pitch of the inner tube coil along the length thereof so that the pitch could be tighter adjacent the inner tube coil ends or the pitch could be tighter at the middle portion of inner tube 61. However, it is preferred that the pitch be uniform along the length of inner tube 61 as shown.

COOLING THEORY

The non-deformable characteristic of internal heat exchange tube 44 of the present invention will be explained by first referring to what is believed to occur when water is directly injected into a heated, conventional Intra-Kool tube. This is diagrammatically illustrated in FIGS. 7 and 8 and is somewhat subjective because of the difficulty encountered in attempting to measure the thermal stresses. That is, thermal stress gradients form rapidly and thermocouples cannot accurately sense over the fractional time period of stress formation the actual stresses and secondly, the thermocouples themselves act as heat sinks which distort any attempt to measure the actual gradients. However, when water is injected into a conventional pipe 90 heated at elevated temperatures, i.e. 1300°-1500° F., it will immediately flash into steam over some length of the pipe indicated in FIG. 7 as the distance between points 91, 92. A steam barrier will be formed which is generally indicated by dot-dash lines 93, 94 but which may or may not take the shape shown by the dot-dash lines. Eventually steam barrier 93, 94 will be broken through by a plug of water diagrammatically shown as line 95. When the water breaks through the steam barrier, a very high circumferential stress gradient will be formed around pipe 90. Now water or any other liquid cannot be injected into pipe 90 so that its leading edge can be perfectly normal to the pipe wall through any cross-sectional slice of the pipe. In fact, it is believed that gravity will force the water to assume the skewed leading edge profile indicated by line 95 in FIG. 7. If a cross-sectional slice were taken through pipe 90 at the leading edge of water plug 95 as shown in FIG. 8, the radial temperature gradients through the pipe wall indicated as temperatures T2, T3 in FIG. 8 would, for a fraction of an instant, be significantly greater than the radial temperature gradient at the top of the wall indicated by temperature T1. Each radial temperature gradient through the wall establishes a thermally induced radial stress and since the stresses are different at various points about the pipe section, a thermally induced circumferential stress gradient is produced. Thus a much higher stress exists in FIG. 11 for T2 and T3 than that which exists for T1. It is to be understood that when circumferential stress gradients are discussed herein, what is meant is the difference in the radial stresses through the tube wall measured about at different circumferential positions on a plane cut normal to the tube.

This is a very simplistic analysis of the problem. For instance, steam pockets randomly occur while water is flowing through pipe 90. However, if the pipe were horizontally placed in furnace 10, the circumferential stress pattern described in FIG. 91 resulting from the thermal gradient measured from the outer surface of pipe 90 to the inner surface of pipe 90 will bend pipe 90 upwardly. The elastic limit of the steel will be exceeded. The pipe will be permanently bent. The yield point of the material will be decreased and eventual failure of the pipe from thermal shock will occur.

By injecting water into inner tube 61 coiled as a helix, the circumferentially measured, radial stress patterns are believed to rotate as the plug of water spirals down the length of inner tube 61. This is believed to result in a rotation of the circumferential stress gradient. That is, the high stresses indicated at temperatures T2 and T3 would rotate to T1 and T3 and then to T1 and T2 with the result that the tendency of tube 61 to bend at any given longitudinal section taken through the coil will be balanced by the circumferential stress pattern generated at a longitudinally displaced section. This rotational displacement of the circumferential stress gradients counteracts any tendency of the water to bend or distort inner tube 61. When water plug 95 reaches inner end 82 of inner tube 61, it dead ends against closed end 64 of outer tube 60 and reverses its longitudinal flow direction to exit open end 65 of outer tube 60. As water plug 95 travels the length of outer tube 60, it follows the helical coil shape of inner tube 61 and this in turn establishes the balancing circumferential stress gradients through outer tube 60 which prevent distortion or bending of outer tube 60.

Over the years, experiments have been made with the use of core busters inserted into heat exchange pipe 90. A core buster can be viewed as a thin rectangular bar which has a width approximately equal to the inside diameter of pipe 90 and which is twisted about its longitudinal axis. When core busters have been inserted into pipe 90, reduced bending of the pipe occurs. However, the bending is not eliminated and failure still occurs. The fact that there is significantly less bending with the present invention when compared to that obtained when core busters have been used and the fact that failures do not occur in the inner-outer tube configuration of the present invention is believed explained for any one or any combination of the following reasons:

1) The pitch which can be formed with the inner tube 61 coiled in the shape described is much tighter than the pitch which can be formed in a core buster. When steam pockets randomly form, tightness of the turn distributes the circumferential stress gradient in a balancing manner not possible with a core buster.

2) Inner tube 61 has a very thin wall of sheet metal gauge thickness. It is thermally impossible because of the thinness of the wall section, to establish a radial temperature stress gradient which exceeds the properties of the material. Importantly, the coil shape is such as to contact the inner surface of outer tube 61 establishing cooling by conduction and convection from inner tube 61 to outer tube 60 during the time period it takes water plug 95 to form and traverse the length of inner tube coil. This time period can be anywhere from six or so seconds to several minutes from the time water is initially injected into inner tube 61 to the time water is observed to flow into drain box 79. Thus, the temperature of outer tube 60 is reduced by inner coil contact and cooling to a temperature which is lower than that which otherwise would be present when water plug 95 breaks the steam barrier at the inside surface of outer tube 61. Thus a lower radial stress gradient results when the water plug 95 eventually breaks the steam barrier formed at the inner surface of outer tube 60.

3) As postulated in Mayers et al '569, the "slug" of steam formed between points 91 and 92 is believed lengthened when mist cooling is used and this lengthened slug means that the temperature of pipe 90 is less when the steam barrier is broken by water plug 95 so that the radial stress gradients are reduced. Applying the "slug" analogy to the present invention, the flow path of the coolant through inner tube 61 is significantly longer because of its coil shape than that through a straight pipe. This increases the residence time and lengthens the steam slug formed to produce a more gradual cooling in the thicker wall section of outer tube 60 thus lowering the radial stress gradients therethrough to a non-destructive level. This holds only for the initial water pulse through heat exchange 44.

As noted above, it is difficult to accurately specify precisely what is thermally occurring because of the short time span of the temperature induced circumferential stress gradient and the difficulty in accurately measuring the stresses in that time span. However, it is believed that the axial, temperature induced stress gradient does not cause pipe failure and that the radial, temperature induced stress gradient, even in the thicker wall section of outer tube 60, does not proximately cause tube failure when compared to the circumferential stress gradient which is known to cause pipe bending and distortion. Further, the injection of water directly into inner tube 61 results in outer tube 60 becoming cooler in a much faster time than that achieved with the mist-spray arrangement disclosed in Mayers et al and without controllability problems inherent in the Mayers et al solution. Finally, not only thermal failure which is addressed in Mayers et al but also pipe bending or distortion is for all practical purposes eliminated in the present invention.

In summary, all of the previous designs of internal heat exchanges showed some evidence of non-uniform cooling. Specifically, temperature gradient between the top and bottom sides of the tube occurred when water was introduced into the tubes. As a result, the tube would bow up. The use of a twisted strip of metal referred to as a turbulator improved the situation but did not eliminate it. Also, mist cooling which slowed the cooling rate and consequently gradient was difficult to control.

The design of the present invention evolved from trying to find a way to initially cool the prior art tube slower while reducing the circumferential gradients. The design of the present invention accomplishes both goals and provide additional benefits. The design of the present invention consists of a small diameter tube, i.e. ⅜" OD, formed in the helical pattern and inserted in a larger diameter, i.e. 1" ID, conventional heat exchange tube, i.e. the outer tube.

Cooling occurs by first introducing water into the small diameter tube. Because the water flows in a helical pattern, the circumferential gradient in the outer tube is minimized. This is a result of the short distance between the loops of the inner tube and the relatively slow heat transfer between the inner tube and the outer tube.

The initial flow of water flashes to steam inside the internal ⅜" diameter coil inner tube. The steam exits the coil tubing and flows back toward the inlet. This steam provides a controlled vapor cool for the outer tube which is finned.

Once the water reaches the end of the small diameter tube, it is discharged to the inside of the outer tube where it flows back toward the inlet. Because of the helical pattern of the inner tube, the return water flows in a spiral path back to the inlet. This spiral path again minimizes circumferential gradients in the outer tube. The direct water contact on the ID of the outer tube also provides the high heat removal capacity desired with an internal heat exchange tube.

By installing the internal cooling tube, pre-cooling of the outer tube is achieved in a slow and uniform manner. The internal cooling tube also provides a channel for direct contact water to back-flow in a spiral pattern out of the outer tube.

The fact that the inner-outer tube arrangement of the present invention is effectively single-ended allows for simple installation. All of the expansion-contraction of the prior art internal heat exchange tube during its thermal cycle can be easily accommodated in the furnace. There are no elaborate expansion joints required where the outer tube passes through the furnace casing. Also, the required number of openings in the furnace casing are significantly reduced.

The invention has been described with reference to a preferred embodiment. Obviously, alterations and modifications will occur to others upon reading and understanding the present invention. For example, the invention has been described with reference to a heat treat furnace which in a commercial sense is distinguishable from furnaces sold to steel mills. Obviously, unless otherwise indicated, heat treat furnace is used, in a generic sense and the invention can be used in the mill field. It is also possible to use a coolant other than water. For example, air or a mist spray could be used or another liquid such as Dow Therm which would be collected at the drain and pumped back, after cooling, in inner tube 61 could be employed. It is intended to include all such modifications and alterations insofar as they come within the scope of the present invention.

Having thus defined the invention, the following is claimed:

1. Apparatus for cooling the work in an industrial furnace comprising:

at least one longitudinally-extending outer tube of predetermined diameter, said outer tube closed at one axial end while open at its opposite axial end and positioned within said furnace with its open end outside said furnace;

a second open ended, longitudinally-extending inner tube having an outside diameter smaller than the inside diameter of said outer tube and positioned to longitudinally extend within said outer tube; said inner tube bent over a longitudinally-extending portion thereof in the form of a helical coil and snugly fitting within said first tube; and means for injecting a coolant into said inner tube at said inner tube's open end which is closest to said outer tube's open end for initially cooling said outer tube by said inner tube and finally cooling said outer tube by said coolant when said coolant exits said inner tube's open end closest said closed end of said outer tube and returns to said open end whereby thermal distortion of said outer tube is minimized.

2. Apparatus of claim 1 wherein said inner tube is formed in the shape of a continuous coil which contacts the inside wall of said outer tube to partially cool said outer tube by conduction when the coolant is initially injected into said inner tube.

3. Apparatus of claim 1 wherein said inner tube is coiled in the shape of a helix extending along said longitudinally-extending portion whereby said coolant within said outer tube and outside said inner tube travels through said outer tube in a helical path defined by the helical configuration of said inner tube to minimize circumferential temperature gradients within said outer tube and prevent distortion thereof.

4. Apparatus of claim 1 wherein a plurality of pairs of outer and inner tubes extend within said furnace, said closed end of said inner tube of each pair contained within said furnace, said open end of said outer tube of each pair outside said furnace, means to seal said outer tube of each pair within said furnace only at the point where said outer tube extends through the exterior wall of said furnace, and manifold means for injecting coolant into said second tube of each tube pair and for collecting spent coolant from said open end of said outer tube of each pair.

5. Apparatus of claim 1 wherein the coolant is water.

6. Apparatus of claim 3 wherein said inner tube coil has a pitch as tight as twice the diameter of said inner tube and said inner tube coil has an outside diameter approximately equal to the inside diameter of said outer tube.

7. Apparatus of claim 6 wherein said outside diameter of said inner tube is not greater than about one-half the inside diameter of said outer tube.

8. An apparatus for cooling metal work within an industrial furnace by means of a plurality of heat exchange tubes extending within a heat treat chamber of said furnace, the improvement comprising:

a longitudinally-extending inner tube coiled in the general shape of a helix and positioned within each heat exchange tube;

each heat exchange tube closed at its axial end, said axial end positioned and terminating within said furnace;

means to inject a liquid into the open end of said inner tube adjacent the open end of each heat exchange tube for gradually cooling each heat exchange tube when said liquid is within said inner tube and rapidly cooling each heat exchange tube when said liquid is in contact with said heat exchange tube without substantial distortion thereof; and outlet means only at the open end of each heat exchange tube for recovering the spent coolant.

9. Apparatus of claim 8 further including said furnace having a furnace casing defining a heat treat enclosure into which said heat exchange tube and said inner tubes extend; each heat exchange tube extending as a straight tube into said chamber and supported adjacent its closed end by a hanger secured at one end to said casing and at its opposite end to a cylindrical sleeve, said sleeve slidingly engaging each heat exchange tube whereby each heat exchange tube can move relative to said sleeve to permit slight movement resulting from thermal expansion and contraction.

10. Apparatus of claim 9 wherein said inner tube coil has a pitch as tight as twice the diameter of said inner tube and said inner tube coil has an outside diameter approximately equal to the inside diameter of said heat exchange tube.

11. Apparatus of claim 10 wherein said outside diameter of said inner tube is not greater than about one-half the inside diameter of said heat exchange tube.

12. The apparatus of claim 11 wherein said inner tube is thin walled tubing of any specified gauge thickness and said heat exchange tube has a wall thickness greater than the wall thickness of said inner tube.

* * * * *